United States Patent [19]

Wales et al.

[11] 3,938,460

[45] Feb. 17, 1976

[54] SAIL-RAISING SYSTEM

[75] Inventors: Walter M. Wales; Donald K. Mitchell, both of Marblehead; Kenneth C. Smalley, Beverly, all of Mass.

[73] Assignee: Hood Sailmakers, Inc., Marblehead, Mass.

[22] Filed: Mar. 4, 1974

[21] Appl. No.: 447,497

[52] U.S. Cl. ..... 114/106
[51] Int. Cl.[2] ..... B63H 9/04
[58] Field of Search ..... 114/89–115

[56] References Cited

UNITED STATES PATENTS

| | | | |
|---|---|---|---|
| 92,539 | 7/1869 | O'Neill | 114/100 |
| 3,040,690 | 6/1962 | Harless | 114/108 |
| 3,611,969 | 10/1971 | Hood | 114/106 |
| 3,789,790 | 2/1974 | Crall | 114/106 |
| 3,851,609 | 12/1974 | Stearn | 114/105 |

*Primary Examiner*—Trygve M. Blix
*Assistant Examiner*—Jesus D. Sotelo
*Attorney, Agent, or Firm*—Kenway & Jenney

[57] ABSTRACT

In a jib sail system, roller-furling and interchangeability of jibs is provided by utilizing a rotatable, slotted stay member, preferably aerodynamically shaped, and by providing at the top of the stay member a ratchet-latching mechanism so that tension on the jib halyard can be released thereby facilitating a swivel coupling attachment of the halyard to the head of the jib.

4 Claims, 8 Drawing Figures

SAIL-RAISING SYSTEM

BACKGROUND OF THE INVENTION

This invention relates to a jib sail system and more particularly to such a system which facilitates roller-furling of a raised jib and which permits jibs to be readily interchanged.

While roller-furling jib systems have been proposed heretofore, e.g. as in the jib-furling stay system disclosed in co-assigned U.S. Pat. No. 3,611,969, such systems have required relatively elaborate and expensive swivel mechanisms to permit furling of the jib without twisting of the jib halyard.

Among the several objects of the present invention may be noted the provision of the jib sail apparatus which permits simple and reliable roller-furling of a jib sail; the provision of such apparatus which permits jib sails to be readily interchanged; the provision of such a system which reduces compression-loading of the mast of the sailboat in which the system is utilized; and the provision of such a system which is relatively simple and inexpensive. Other objects and features will be in part apparent and in part pointed out hereinafter.

SUMMARY OF THE INVENTION

Briefly, sail-raising apparatus according to the present invention employs a stay member having therein an elongate slot of generally C-shaped cross-section. The stay member is mounted with respect to the bow and mast of the sailboat with which the apparatus is used to permit rotation of the stay member around its longitudinal axis. A carrier is slidable along the stay member and rotatable therewith, the carrier having means for attaching the head of a jib to permit hoisting of the jib by the carrier. Swivel means are provided for rotatably attaching a halyard to the carrier for hoisting of the carrier with the jib. At the upper end of the stay member is a rack and, on the carrier, a pawl is provided for engaging the rack. Thus, once the jib sail is raised, tension on the halyard may be released while the jib sail itself is held up under compression borne by the stay member itself. Accordingly, the stay member may be rotated with the hoisted jib without twisting the halyard, the halyard and the swivel bearings being substantially unloaded.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
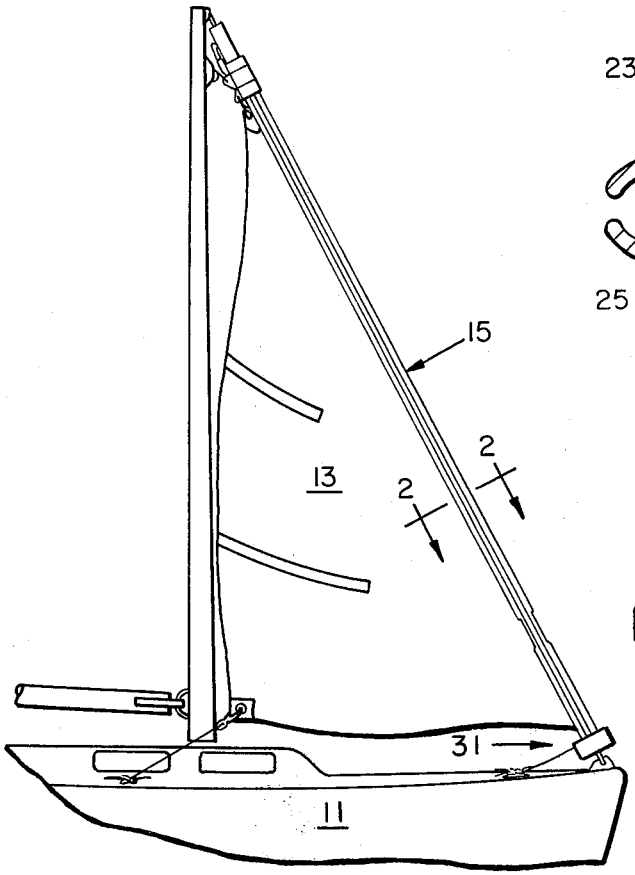
FIG. 1 is a somewhat diagrammatic view of the bow portion of a sailboat employing jib sail apparatus in accordance with the present invention.
Figure 2:
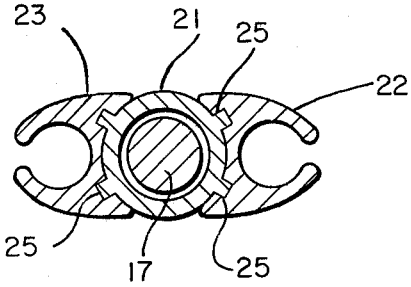
FIG. 2 is a cross-section taken substantially on the line 2—2 of FIG. 1 showing a composite rotatable stay assembly.

Referring now to FIG. 1, there is shown a sailboat 11 having a jib 13 raised with its luff in a rotatable, slotted headstay member 15 constructed in accordance with the present invention. In one preferred embodiment of the invention, the stay assembly 15 employs, as illustrated in FIG. 2, a conventional wire headstay 17 over which are assembled a series of interlocking aluminum extrusions 21, 22, and 23 which together comprise a doubly-slotted headstay member of essentially streamlined or oblate configuration. The central extrusion 21 is essentially tubular in cross-section and fits over the headstay wire 17. The extrusions 22 and 23 on either side of the central extrusion 21 are provided with grooves which interlock with ribs 25 on the central extrusions. In this way, the composite stay member may be assembled by sliding the mating extrusions together.

Figure 3:
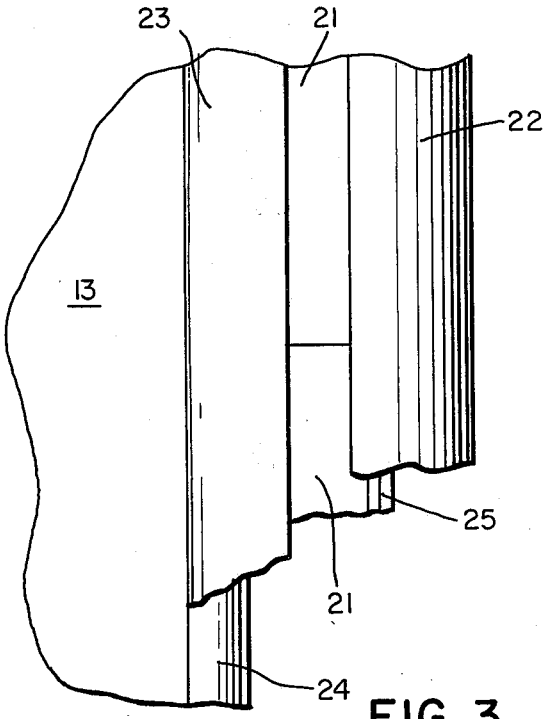
FIG. 3 is a side view of a partial joint in the stay assembly.
Figure 4:
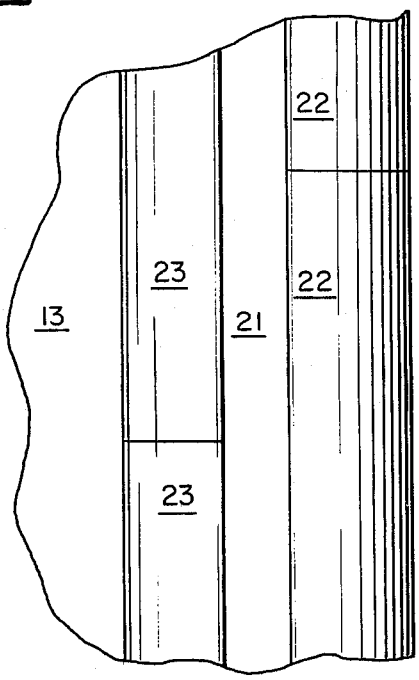
FIG. 4 is a side view of another form of joint in the stay assembly.

In order to limit the length of extrusion needed, each type of extrusion may be made up in relatively short lengths, e.g. five feet, while a relatively long composite stay member can be made up by staggering the joints of the sections of the central extrusion 21 with the joints of the extrusions 22 and 23. This is illustrated in FIGS. 3 and 4. In general, the central extrusion 21, being generally tubular, possesses sufficient torsional rigidity to permit roller-furling as described hereinafter, while the extrusions 22 and 23 provide a joining of successive sections of the central extrusion 21 which prevents relative rotation between the successive sections.

Figure 5:
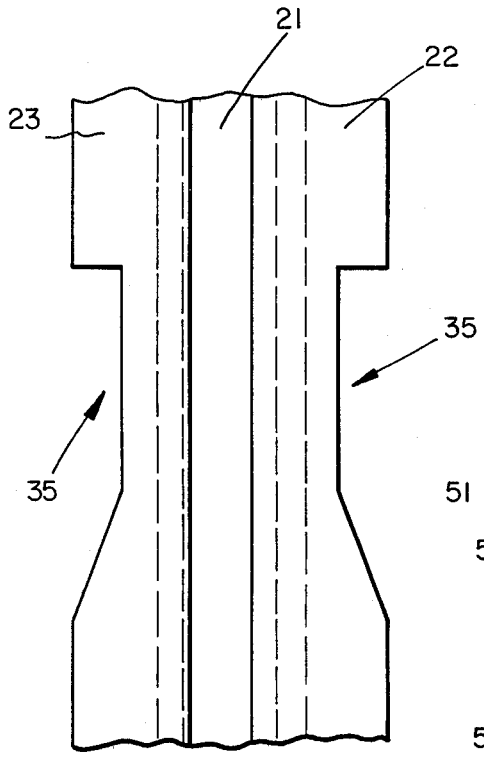
FIG. 5 is a side view illustrating a feed point in the slotted stay assembly.

The lower ends of the composite rotatable stay member comprising extrusions 21, 22, and 23 are clamped to a drum-like roller-furling and swivel assembly 31. Each of the extrusions 22 and 23 includes a longitudinal slot having an essentially C-shaped cross-section, which opening or slot functions in generally the same manner as the C-shaped stay described in the earlier patent, that is, the slot receives a bolt-rope or bead 24 formed on the luff edge of the jib sail used in conjunction with the roller-furling apparatus. Similarly, at one point along its length, each C-shaped slot is cut away or opened up, as illustrated at 35 in FIG. 5, so as to permit the bead to be introduced into the slot, the mouth of the C otherwise being narrow enough to retain the bead along the major portion of the length of the stay member 15. Suitable guides or feeders facilitating the raising of a jib may be employed as described in U.S. Pat. Nos. 3,658,025 and 3,759,210, also co-assigned with the present invention. The provision of two slots allows a second jib to be set.

Figure 6:
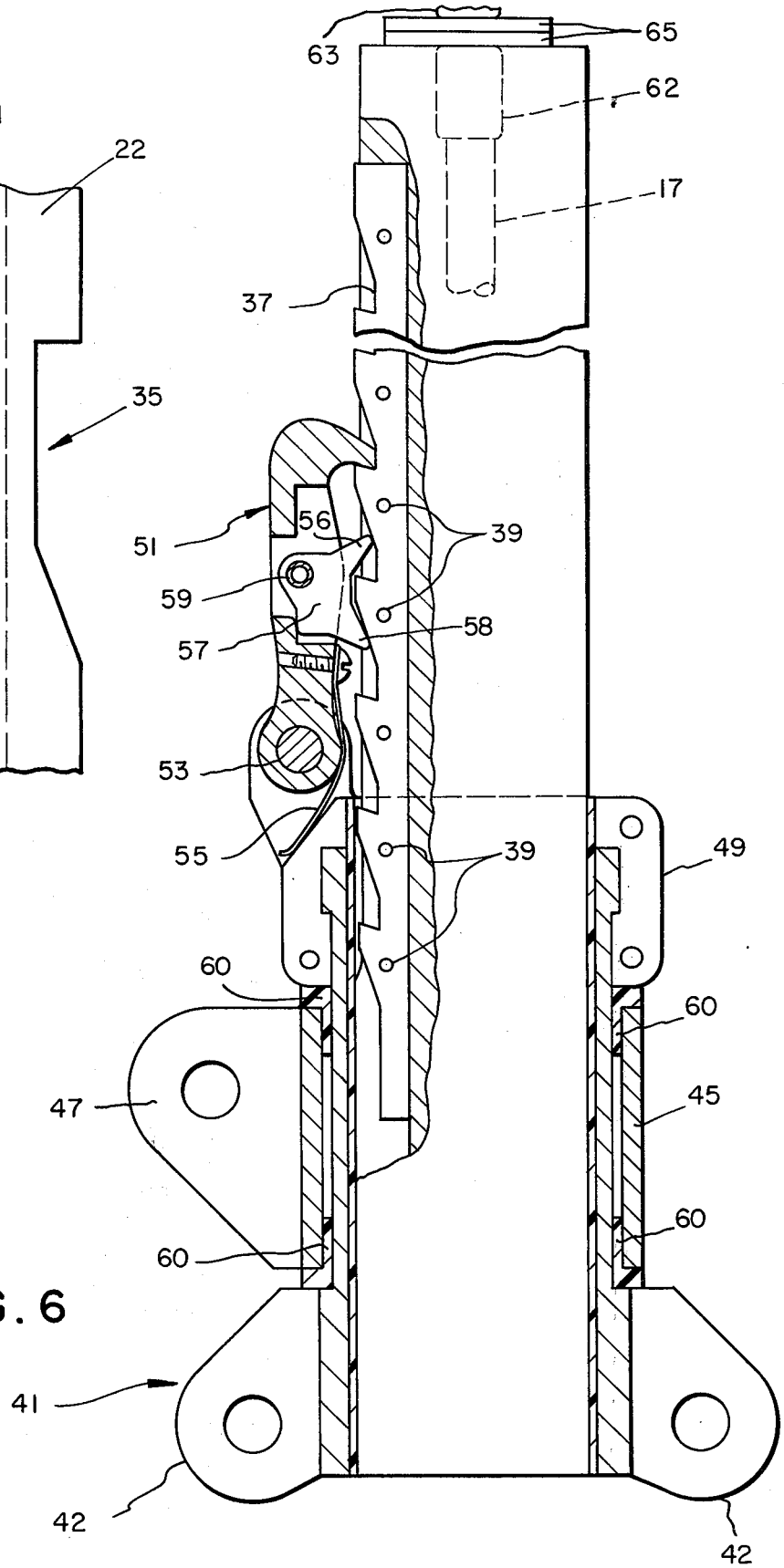
FIG. 6 is a side view, with parts broken away, of a ratchet mechanism employed in apparatus of the present invention.

The upper end of the composite stay assembly is provided with a ratchet rack 37 as illustrated in FIG. 6. Preferably, rack 37 is formed as a notched length of rod having a nominally circular cross-sectional shape which fits snugly within one of the C-shaped slots, the mouth of the slot being cut away slightly as illustrated to provide greater access to the notches. The rack 37 is locked in place by a series of pins as indicated at 39 in FIG. 6.

A carrier 41 is provided which fits over and is slidable along the composite stay member, the carrier and the composite stay member having essentially matching, non-circular cross-sections which cause the carrier to rotate with the composite stay member. The slider or carrier 41 carries a pair of apertured tabs 42 to which the head of the jib sail can be shackled, as illustrated. A freely rotatable swivel ring 45 is provided around the carrier and the ring carries an apertured tab 47 to which the jib halyard may be attached, again as illustrated.

The ring 45 is retained on the carrier 41 by a split collar 49 which is clamped on the upper end of the carrier. Collar 49 carries a hook 51 which is pivoted at 53 and is biased, by means of a spring 55, into engagement with the ratchet rack 37. As may be seen, hook 51 cooperates with the ratchet rack 37 so as to provide a means for latching the carrier into a jibraised position.

Figure 7:
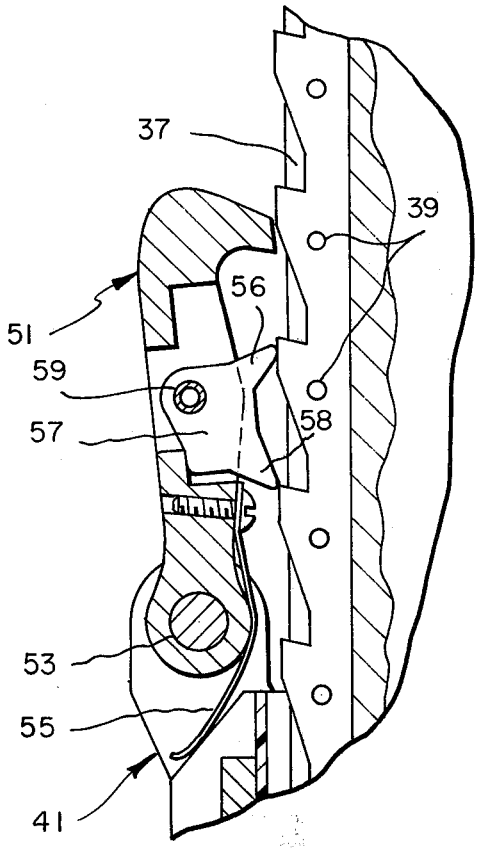
FIGS. 7 and 8 show different positions of elements in the ratchet mechanism during its operation.
Figure 8:
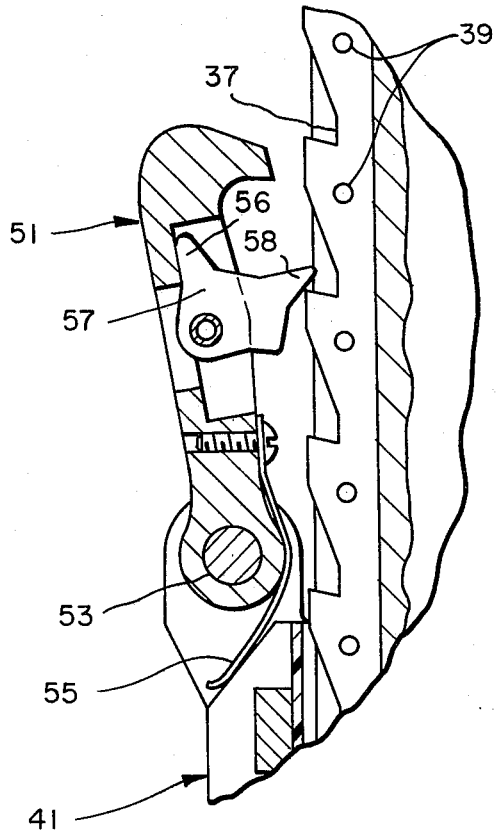

To permit the carrier to be lowered, the hook 51 carries a rocker element 57 which is pivotally mounted on the hook itself as indicated at 59. Rotational movement of the rocker element 57 is limited by the shape of the cavity in the hook within which it is mounted. When the carrier is being raised, the rocker element does not significantly interfere with the expected operation of the hook 51, the spacing between the two fingers 56 and 58 of the rocker element matches the spacing between successive notches in the rack 37 as illustrated in FIG. 7. Thus, the nose of the hook can fall into and engage one of those notches. If, however, the hook is advanced to a position just short of falling into one of the notches so that the lowermost finger 58 of the rocker has fallen into a notch but the hook 51 has not, and if the carrier is then lowered, the rocker element will rock over to a position as illustrated in FIG. 8 where the backside of the finger 58 acts as a ramp tending to lift the hook over the point of each notch so that the hook does not engage and does not impede the lowering of the carrier. Stated in other terms, the carrier is released for lowering by initially raising it about half a rack notch and then lowering.

The use of a ratchet latch in accordance with the present invention to hold the carrier and jib in raised position provides several advantages. When the hook 51 is engaged, tension can be let off the jib halyard. Accordingly, it is not necessary to provide expensive ball bearings to permit the halyard ring 45 to rotate with respect to the carrier 41 during rollerfurling of the jib sail, since the swivel is unloaded. This arrangement also reduces compression loading of the mast. Likewise, since the jib luff tension is not transmitted to the bow of the boat, the foot of the jib being attached directly to the drum mechanism which is in turn mounted directly on the bottom of the rotatable stay. Accordingly, no elaborate swivels are needed to mount the rotatable stay assembly 15 but rather it can rotate over the stay wire 17 on simple sleeves 62 of a plastic material such as that sold under the trade name Teflon. Axial travel of the rotating assembly 15 can then be constrained by simple swaged stops 63 bearing against washers 65 which contact the end of the composite rotating assembly.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. Jib-setting apparatus comprising:

a wire tension member;

a series of similar tubular extrusions adapted to fit over said wire, each of said extrusions being grooved on opposite sides thereof;

on one side of said series of tubular extrusions, a first series of extrusions each having a portion of generally C-shaped cross-section forming an elongate slot, the extrusions in said first series being grooved to engage and lock onto the grooves on said one side of the tubular extrusion with the abutting ends of extrusions in said first series being staggered with the abutting end of said series of tubular extrusions; and on the opposite side of said series of tubular extrusions, a second series of extrusions each having a portion of generally C-shaped cross-section forming an elongate slot, the extrusions in said second series being grooved to engage and lock onto the grooves on said other side of the tubular extrusion with the abutting ends of extrusions in said second series being staggered with the abutting end of said series of tubular extrusions.

2. Apparatus as set forth in claim 1 further comprising;

a carrier slidably along the interlocked assembly of extrusions and rotatable therewith, said carrier having means for attachment of the head of a jib to permit hoising of the jib with the carrier;

swivel means rotatably mounted on said carrier and including means for attaching a halyard for hoisting said carrier;

at the upper end of said first series of C-shaped extrusions, a rack; and on said carrier, a pawl for engaging said rack thereby to permit tension on said halyard to be released while said jib is held up under tension borne by said stay assembly, whereby said stay assembly may be rotated with a jib hoisted without twisting said halyard, the halyard being unloaded.

3. Apparatus as set forth in claim 2 wherein said rack comprises a member, nominally of circular cross-section, fitting within said C-shaped slot, said rack member having a series of notches therein facing outwardly.

4. Sail-raising apparatus comprising:

a wire tension headstay member;

a series of similar tubular extrusions adapted to fit over said wire, each of said extrusions being grooved on opposite sides thereof;

on one side of said series of tubular extrusions, a first series of extrusions each having a portion of generally C-shaped cross-section forming an elongate slot, the extrusions in said first series being grooved to engage and lock onto the grooves on said one side of the tubular extrusion with the abutting ends of extrusions in said first series being staggered with the abutting end of said series of tubular extrusions;

on the opposite side of said series of tubular extrusions, a second series of extrusions each having a portion of generally C-shaped cross-section forming an elongate slot, the extrusions in said second series being grooved to engage and lock onto the grooves on said other side of the tubular extrusion with the abutting ends of extrusions in said second series being staggered with the abutting ends of said series of tubular extrusions;

means for mounting said headstay member with respect to the bow and mast of a sailboat with which the apparatus is used, to permit rotation of said extrusions around said headstay member;

a carrier slidably along said extrusions and rotatable therewith, said carrier having means for attachment of the head of a jib to permit hoisting of the jib with the carrier;

swivel means rotatably mounted on said carrier and including means for attaching a halyard for hoisting said carrier;

at the upper end of said stay member, a rack comprising a member, nominally of circular cross-section, fitting within said C-shaped slot, said rack member having a series of notches therein facing outwardly; and on said carrier, a pawl for engaging said rack thereby to permit tension on said halyard to be released while said jib is held up under tension borne by said extrusions, whereby said extrusions may be rotated with a jib hoisted without twisting said halyard, the halyard being unloaded.

* * * * *